US005094597A

United States Patent [19]

Takai et al.

[11] Patent Number: 5,094,597

[45] Date of Patent: Mar. 10, 1992

[54] VARIABLE DISCHARGE PUMP

[75] Inventors: Yoshiki Takai; Teruhiko Mochizuki, both of Kanagawa, Japan

[73] Assignee: Atsugi Unisia Corporation, Kanagawa, Japan

[21] Appl. No.: 514,668

[22] Filed: Apr. 25, 1990

[30] Foreign Application Priority Data

Apr. 27, 1989 [JP] Japan ..... 1-108152

[51] Int. Cl.[5] ..... F04B 23/04

[52] U.S. Cl. ..... 417/428; 417/427

[58] Field of Search ..... 417/426, 427, 428, 243

[56] References Cited

U.S. PATENT DOCUMENTS 2,563,356 9/1951 Moulden ..... 417/428

2,621,607 12/1947 Trapp ..... 417/273

FOREIGN PATENT DOCUMENTS 2426904 2/1975 Fed. Rep. of Germany ..... 417/427

*Primary Examiner*—Richard A. Bertsch

*Assistant Examiner*—Charles G. Freay

*Attorney, Agent, or Firm*—Bachman & LaPointe

[57] ABSTRACT

A variable discharge pump comprises a plurality of pumping units, each pumping unit including an outlet port discharging a particular volumetric discharge of working fluid, a plurality of outlet passages respectively communicating the outlet ports of each of the pumping units. Each of the outlet passages includes a supply passage provided for supplying the working fluid to a driven apparatus and a reflux passage provided for returning the working fluid to a working fluid reservoir, both being branched from the outlet passage. The variable discharge pump also includes an electromagnetic valve associated with the outlet passages for selectively switching a plurality of flow passages for the working fluid supplied from each of the outlet ports to either the supply passage or the reflux passage so as to provide a plurality of different volumetric discharges by combination of the particular volumetric discharges from each of the outlet ports and includes a plurality of check valves provided in each of the supply passages so as to prevent back-flow of the working fluid.

2 Claims, 6 Drawing Sheets

VARIABLE DISCHARGE PUMP

BACKGROUND OF THE INVENTION

1. Field of the Invention

The present invention relates to a variable discharge pump, such as a variable discharge plunger pump including a plurality of plungers for discharging pressurized working fluid by reciprocating motion thereof. Specifically to a volumetric discharge control system for a variable discharge pump which can vary a volumetric discharge of working fluid from the pump according to a required volumetric flow for hydraulic apparatus.

2. Description of the Prior Disclosure

There have been proposed and developed various plunger pumps with a plurality of plungers to pressurize and discharge working fluid such as oil by reciprocating motion thereof. Recently, to obtain high pump performance, there has been proposed a plunger pump including a plurality of pumping units, each being arranged on the pump shaft in such a manner as to be axially offset from each other. Each pumping unit includes a set of plungers and a set of plunger chambers formed on the outer peripheral wall of the pump casing in such a manner that the longitudinal axis of each plunger chamber is radially arranged relative to the central axis of the pump shaft at essentially regular intervals and each plunger chamber slidably accommodates the associated plunger. Each of the plungers reciprocates by rotational movement of an eccentric cam whose cam surface abuts mating surfaces on each plunger in such a manner that the above mentioned mating surfaces are normally biased to the above mentioned cam surface by means of compression springs.

In such conventional radial plunger pumps, working fluid pressurized by plural pumping units is supplied from plural discharge passages respectively communicated with the pumping units through a confluent passage converging the discharge passages at a discharge outlet communicating with an inlet port of a hydraulic apparatus, for example a hydraulic motor. Therefore, the sum of the volumetric discharges from the plural pumping units is supplied to the hydraulic apparatus. One such conventional plunger pump has been disclosed in Japanese Patent First Publication (Tokkai) Showa 58-15769.

In conventional plunger pumps as described previously, since a volumetric flow discharged from the pump is determined by revolution of the pump shaft, irrespective of the flow required for the hydraulic apparatus, an imbalance occurs between the volumetric flow actually supplied by the pump and the volumetric flow required by the hydraulic apparatus. If a relatively great volumetric flow of working fluid is supplied to hydraulic equipment requiring a relatively small volumetric flow, waste and inefficiency are introduced and equipment may be damaged. Such conventional plunger pumps are uneconomical.

SUMMARY OF THE INVENTION

It is, therefore in view of the above disadvantages, an object of the present invention to provide a volumetric discharge control system for a variable discharge pump which can vary volumetric discharge of working fluid from the pump according to a volumetric flow required by a hydraulic apparatus.

It is another object of the invention to provide a variable discharge plunger pump which can supply working fluid in a plurality of discharge modes so as to provide different volumetric discharge from the pump in each discharge mode.

In order to accomplish the aforementioned and other objects, a variable discharge pump comprises a plurality of pumping units, each pumping unit including an outlet port discharging a volumetric discharge of working fluid, a plurality of outlet passages, each passage communicating with a respective outlet port, each of the outlet passages being branched into a supply passage provided for supplying working fluid to a confluent supply line for a fluid driven apparatus and a reflux passage provided for returning the working fluid to a working fluid reservoir, and means provided in the reflux passages for selectively switching a plurality of flow passages for the working fluid supplied from each of the outlet ports to either the supply passage or the reflux passage so as to provide a plurality of different volumetric discharges by combination of the volumetric discharges from each of the outlet ports. The switching means includes an electromagnetic solenoid valve associated with each of the reflux passages in a manner so as to selectively return the working fluid from each of the outlet ports to the reservoir. A plurality of check valves are provided respectively in each of the supply passages to prevent back-flow of the working fluid.

According to another aspect of the invention, a variable discharge plunger pump comprises a plurality of pumping units, each pumping unit including at least one plunger chamber slidably accommodating a plunger associated with a rotatable pump shaft having driven connection with an engine, for pressurizing working fluid within the plunger chamber, each of the pumping units including an outlet port discharging a particular volumetric discharge of the working fluid pressurized within the plunger chamber, a plurality of outlet passages, each outlet passage communicating with a respective outlet port, each of the outlet passages being branched into a supply passage provided for supplying the working fluid to a confluent supply line for a fluid driven apparatus and a reflux passage provided for returning the working fluid to a working fluid reservoir, means being provided in the reflux passages for selectively switching a plurality of flow passages for the working fluid supplied from each of the outlet ports to either the supply passage or the reflux passage so as to provide a plurality of different volumetric discharge by combination of the particular volumetric discharges from each of the outlet ports, the switching means including valve means associated with each of the reflux passages in a manner so as to selectively return the working fluid from each of the outlet ports to the reservoir and including a plurality of check valves provided in each of the supply passages to prevent back-flow of the working fluid. The valve means includes an electromagnetic solenoid valve connected to each of the reflux passages and the reservoir.

DESCRIPTION OF THE PREFERRED EMBODIMENT

Figure 2:
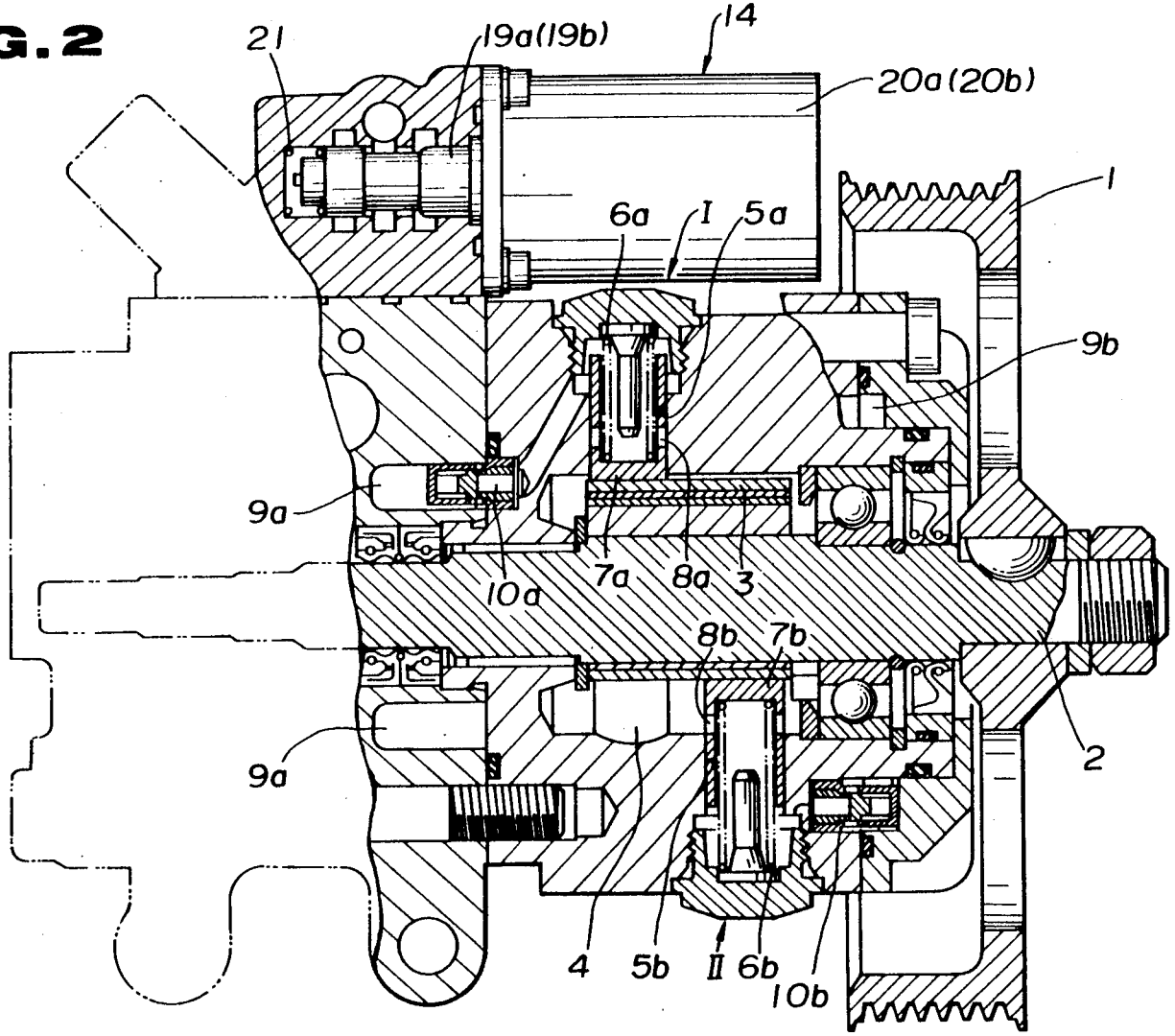
FIG. 2 is a longitudinal cross sectional view illustrating the variable discharge pump according to the invention.

Referring now to the drawings, particularly to FIG. 2, there is shown a variable discharge radial plunger pump assembly according to the invention. The plunger pump assembly includes a first pumping unit I and a second pumping unit II, each being arranged on a pump shaft (camshaft) 2 in such a manner as to be axially offset from each other. As seen in FIG. 2, the first pumping unit I is provided on the left of the second pumping unit II. In general, the pump shaft 2 is driven by an engine (not shown) through a pulley 1 which is securely fixed by a woodruff key inserted into a key-seat formed in the vicinity of one end of thereof. The left-hand pumping unit I includes a set of plungers 7*a* and a set of cylindrical plunger chambers 5*a* formed on the outer peripheral wall of pump casing. Although it is not shown in detail in the drawing, the longitudinal axis of each plunger chamber is radially arranged relative to the central axis of the camshaft 2 at essentially regular intervals and each plunger chamber slidably accommodates the associated plunger. The right-hand pumping unit II includes a set of plungers 7*b* and a set of cylindrical plunger chambers 5*b* formed on the outer peripheral wall in the same manner of the plunger chambers 5*a*. Each of the plungers 7*a* and 7*b* reciprocates by rotational motion of an eccentric cam 3 whose cam surface abuts mating surfaces of each plunger of both first and second pumping units in such a manner that the mating surfaces of each plunger 7*a* included in the pumping unit I are normally biased to the cam surface by means of a compression spring 6*a* and the mating surfaces of each plunger 7*b* included in the pumping unit II are normally biased to the cam surface by means of a compression spring 6*b*.

The reciprocating operation of the plunger 7*a* is similar to that of the plunger 7*b*. For the purpose of simplification of description, only the operation of the plunger 7*a* included in the first pumping unit I will be hereinafter described in detail.

Figure 1:
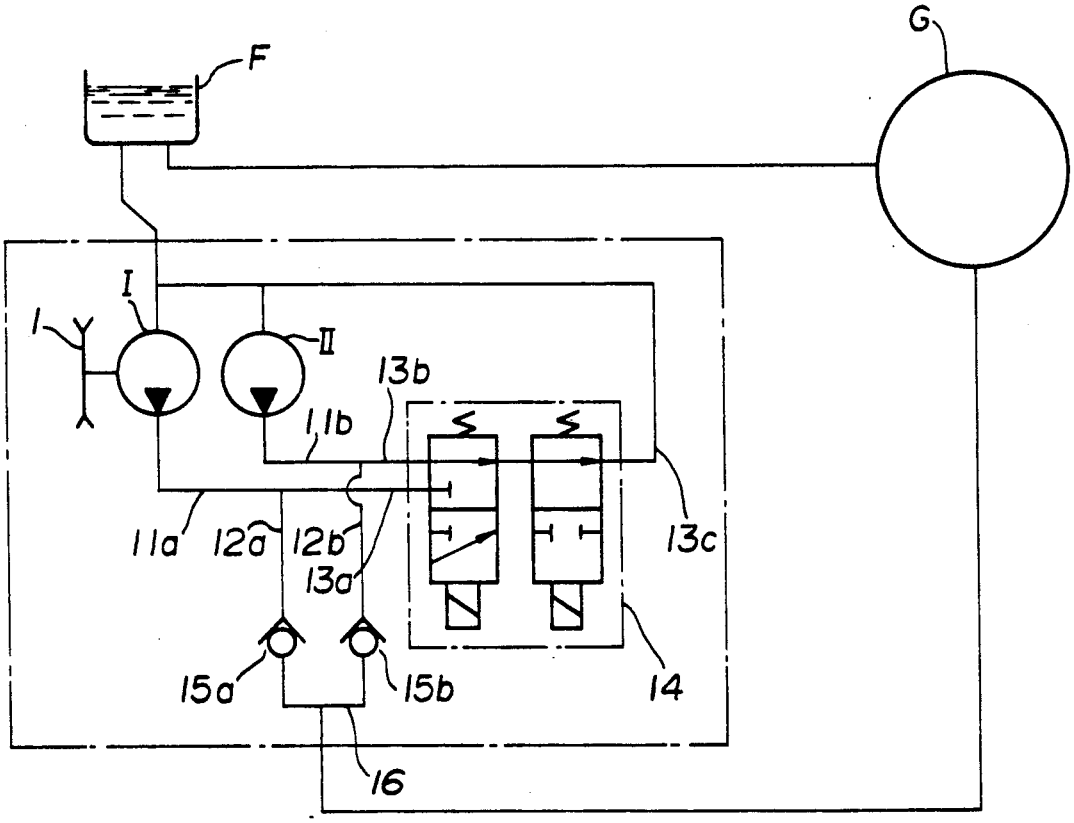
FIG. 1 is a circuit diagram illustrating one embodiment of a variable discharge pump according to the invention.

When the plunger 7*a* moves radially to the direction of the central axis of the pump shaft 2 according to the rotational movement of the cam 3, openings 8*a* bored in the side wall of each plunger 7*a* are exposed to a suction chamber (low pressure chamber) 4 defined in the pump casing. The suction chamber 4 is communicated with an outlet port of an oil reservoir F via a conduit as shown in FIG. 1. Thus, working fluid in the suction chamber 4 is introduced into the plunger chamber 5*a*. After this, as the plunger 7*a* moves away from the central axis, the openings 8*a* are closed and then the working fluid within the chamber 5*a* is pressurized. The pressurized working fluid is supplied from the chamber 5*a* via a discharge valve, such as a check valve 10*a* into a high-pressure chamber 9*a*. Likewise, the second pumping unit II provides a pressurized high-pressure working fluid from the suction chamber 4 through openings 8*b* bored in the side wall of the plunger 7*b*, the plunger chamber 5*b* and the discharge valve 10*b* to a high-pressure chamber 9*b*.

FIG. 1 is a schematic hydraulic circuit of a volumetric discharge control system of a variable discharge pump according to the invention. Referring now to FIG. 1, the high-pressure chamber 9*a* included in the first pumping unit I and the high-pressure chamber 9*b* included in the second pumping unit II are communicated first and second outlet passages 11*a* and 11*b*, respectively.

The first outlet passage 11*a* branches off to a first supply passage 12*a* and a reflux passage 13*a*, while second outlet passage 11*b* branches off to a second supply passage 12*b* and a reflux passage 13*b*. The first and second supply passages 12*a* and 12*b* are respectively connected to each inlet port of check valves 15*a* and 15*b*. Outlet ports of the two check valves 15*a* and 15*b* are intercommunicated via a communication passage 16. The communication passage 16 communicates with a conduit for supplying high-pressure working fluid to an inlet port of a hydraulic apparatus G, such as an oil motor. On the other hand, the first and second reflux passages 13*a* and 13*b* are respectively connected to a control valve 14. The control valve 14 is provided for blocking the communication between the first reflux passage 13*a* and a return passage 13*c* connected to the oil reservoir F, between the second reflux passage 13*b* and the return passage 13*c*, and between both of the reflux passages (13*a*; 13*b*) and the return passage 13*c*.

Figure 3:
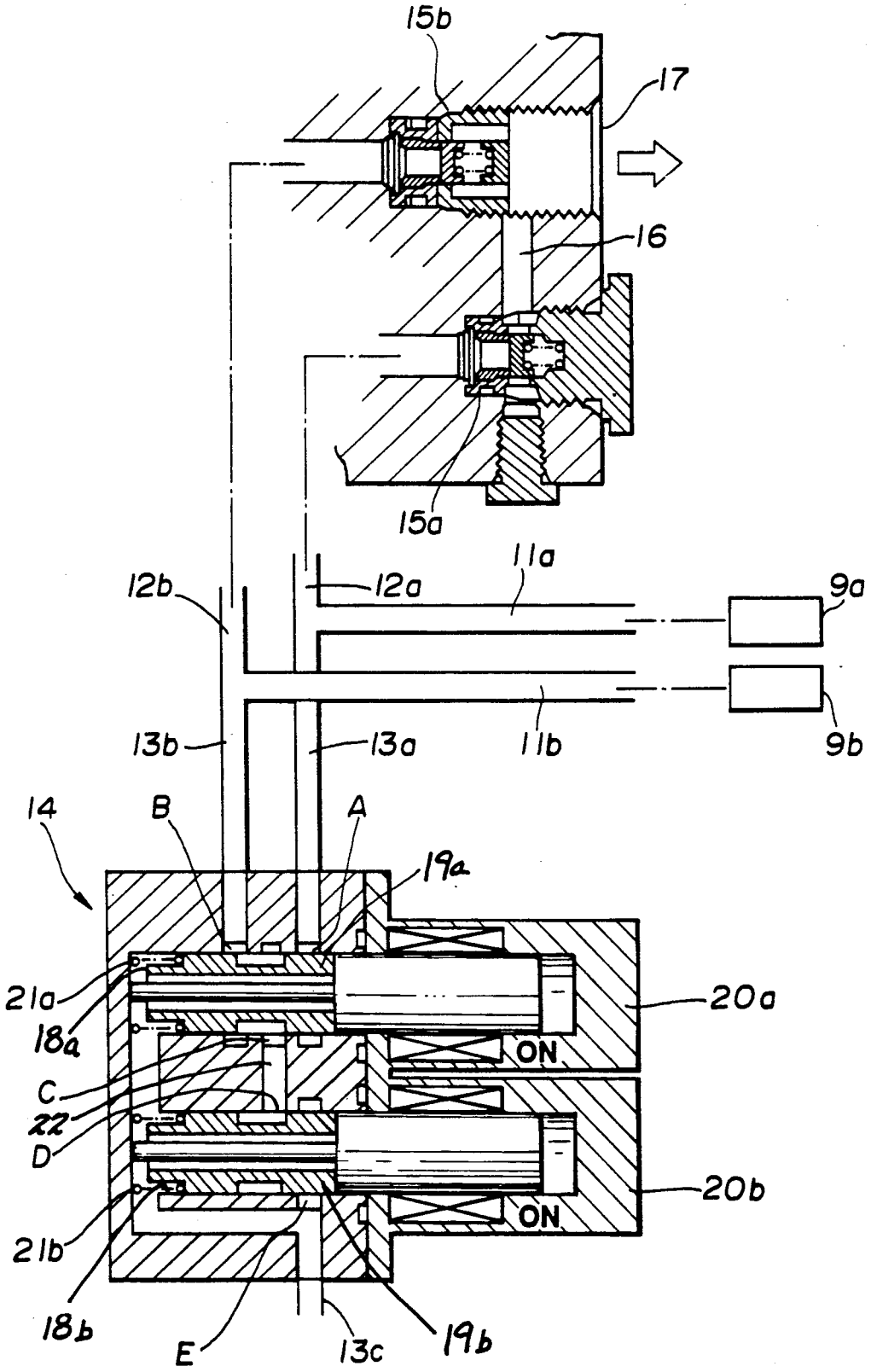
FIG. 3 is a hydraulic circuit illustrating a volumetric discharge control system for a variable discharge pump according to the embodiment of the invention.

The construction of the control valve 14 and the check valves (15*a*; 15*b*) is detailed in FIG. 3.

The control valve includes a pair of spools 19*a* and 19*b* and a pair of cylindrical spool chambers 18*a* and 18*b* slidably accommodating the spools (19*a*; 19*b*), respectively. The spools (19*a*; 19*b*) are normally biased to the right (viewing FIG. 3) by means of compression springs 21*a* and 21*b*. The spools (19*a*; 19*b*) are also associated with electromagnetic solenoids 20*a* and 20*b*, such that the spool is shifted to the leftmost position (viewing FIG. 3) against the spring force generated by the compression spring when the associated solenoid is activated, while the spool remains in the rightmost position (viewing FIG. 3) due to the spring force when the solenoid is deactivated. As shown in FIG. 3, the spool chamber 18*a* is arranged upstream of the spool chamber 18*b*. The upstream spool chamber 18*a* includes two inlet ports A and B respectively communicated with the reflux passages (13*a*; 13*b*) and a port C, while the downstream spool chamber 18*b* includes a port D intercommunicated with the port C through a communication passage 22 and an outlet port E communicated with the return passage 13*c*. In the previously described construction of the control valve 14, assuming that the first and second pumping units I and II are so designed as to provide first and second particular volumetric discharges $Q_1$ and $Q_2$ respectively, three different discharge modes will be obtained by combination of ON/-OFF operations of the solenoids 20*a* and 20*b*.

Figure 4:
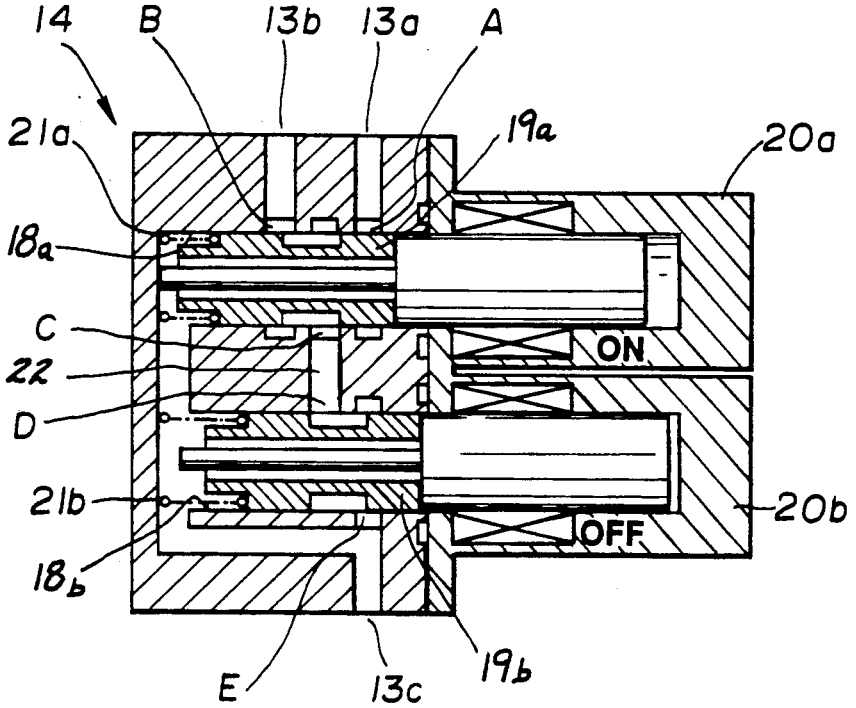
FIGS. 4, 5 and 6 are cross sectional views respectively illustrating a different state of a control valve of the volumetric discharge control system in three discharge modes of the variable discharge pump according to the invention.

FIG. 4 is a section illustrating the control valve 14 of the embodiment operating in a first discharge mode (MODE I) wherein the solenoid 20*a* is activated and the solenoid 20*b* is deactivated. In this state, the ports B and C are intercommunicated and the ports D and E are intercommunicated with the result that the communication between the reflux passage 13b and the return passage 13c is established and the communication between the reflux passage 13a and the return passage 13c is blocked. That is, the second volumetric discharge $Q_2$ of working fluid discharged from the second pumping unit II is drained through the return passage 13c to the oil reservoir F, while the first volumetric discharge $Q_1$ of working fluid discharged from the first pumping unit I is supplied through the first supply passage 12a and the check valve 15a via the communication passage 16 to the discharge outlet 17. Once working fluid passes through the communication passage 16, the working fluid may not flow backward because the two check valves (15a; 15b) prevent back flow. In this manner, only the first volumetric discharge $Q_1$ is supplied to the hydraulic apparatus G in the first discharge mode.

Figure 5:
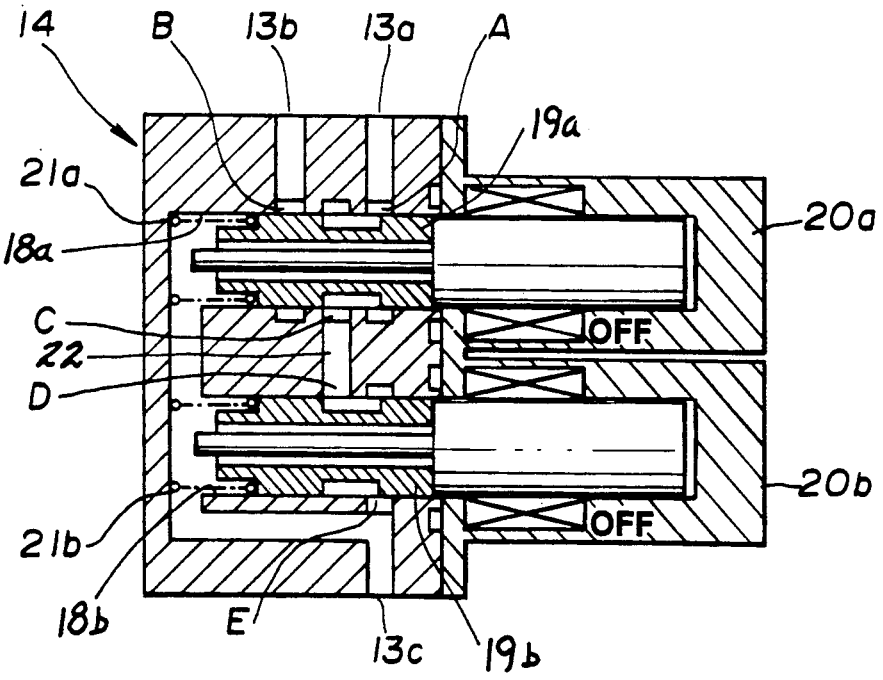

FIG. 5 is a section illustrating the control valve 14 of the embodiment operating in a second discharge mode (MODE II) wherein both of the solenoids 20a and 20b are deactivated. In this state, the ports A and C are intercommunicated and the ports D and E are intercommunicated with the result that the communication between the reflux passage 13a and the return passage 13c is established and the communication between the reflux passage 13b and the return passage 13c is blocked. That is, the first volumetric discharge $Q_1$ of working fluid discharged from the first pumping unit I is drained through the return passage 13c to the oil reservoir F, while the second volumetric discharge $Q_2$ of working fluid discharged from the second pumping unit II is supplied through the second supply passage 12b and the check valve 15b to the discharge outlet 17. In this manner, only the second volumetric discharge $Q_2$ is supplied to the hydraulic apparatus G in the second discharge mode.

Figure 6:
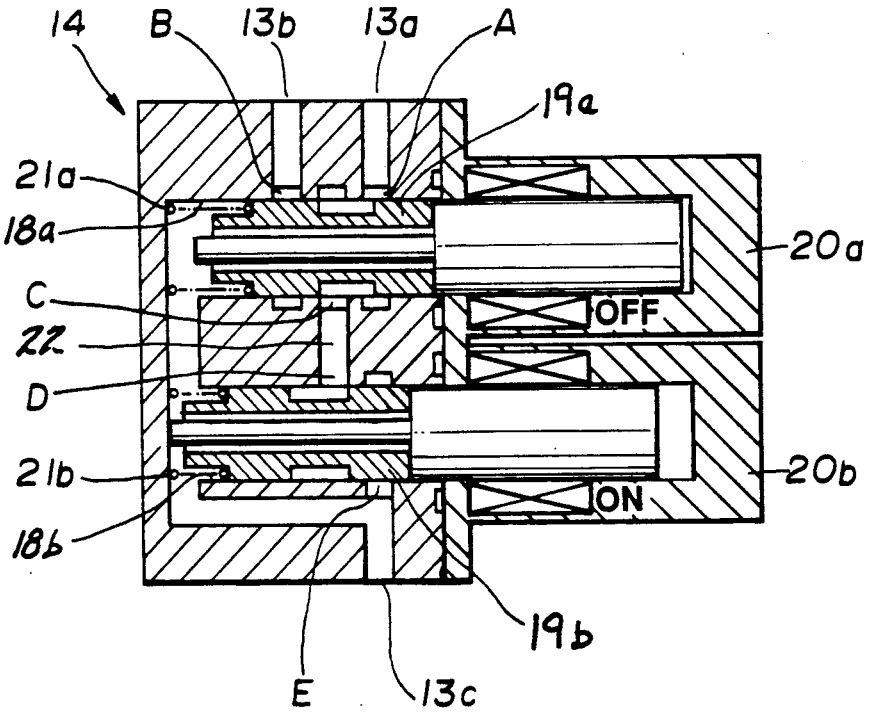

FIG. 6 and FIG. 3 are cross sections illustrating the control valve 14 of the embodiment operating in a third discharge mode (MODE III) wherein the solenoid 20b is activated irrespective of ON/OFF state of the solenoid 20a. In this state, communication between ports D and E is blocked with the result that the communication between the reflux passage 13a and the return passage 13c and between the reflux passage 13b and the return passage 13c is also blocked. That is, the first volumetric discharge $Q_1$ of working fluid discharged from the first pumping unit I and the second volumetric discharge $Q_2$ of working fluid discharged from the second pumping unit II are both supplied through the first and second supply passages (12a; 12b) and the check valves (15a; 15b) and then converged at the discharge outlet 17. In this manner, the sum $(Q_1+Q_2)$ of the first and second volumetric discharges $Q_1$ and $Q_2$ is supplied to the hydraulic apparatus G in the third discharge mode. In actuality, due to different flow resistances in each discharge mode, the volumetric discharge from the discharge outlet 17 in the third discharge mode is slightly different from the sum $(Q_1+Q_2)$.

Figure 7:
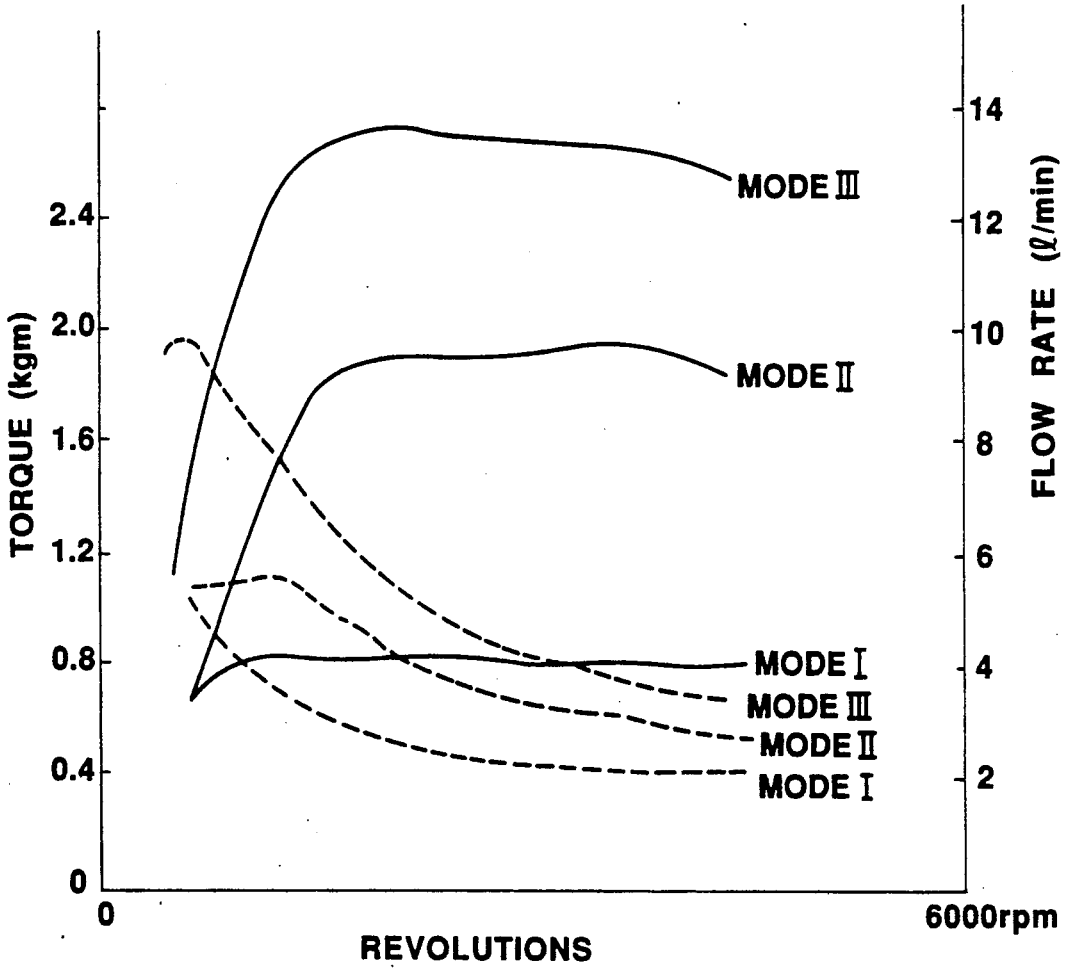
FIG. 7 is a graph illustrating volumetric discharge characteristic curves (indicated by solid lines) of the variable discharge pump of the invention and consumed torque characteristic curves (indicated by broken lines) of a hydraulic apparatus driven by the variable discharge pump according to the invention with regard to revolutions of the pump, in the three discharge modes.

As clearly seen in the graph of FIG. 7, the variable discharge pump of the embodiment according to the invention provides three different volumetric discharges and consequently the consumed torque characteristics are varied depending on each discharge mode.

Although in the previously described embodiment, a discharge control system of a variable discharge pump according to the invention is applied to a radial plunger pump including two pumping units, such a discharge control system may be applied to another type hydraulic pump, such as an axial plunger pump having a plurality of pumping units. Furthermore, a discharge control system for a variable discharge pump according to the invention may also be applied to a plunger pump including two or more pumping units.

Although in the embodiment, the control valve of the discharge control system according to the invention is provided so as to be connected to the reflux passages, a flow control valve may be provided at a branching point between a set of supply passage and reflux passage, for switching working fluid flow either to the supply passage or to the reflux passage.

While the foregoing is a description of the preferred embodiment for carrying out the invention, it will be understood that the invention is not limited to the particular embodiment shown and described herein, but may include variations and modifications without Departing from the scope or spirit of this invention as described by the following claims.

What is claimed is:

1. A variable discharge pump comprising:

a plurality of pumping units (I, II), each pumping unit including an outlet port (9a, 9b) discharging a volumetric discharge of working fluid;

a plurality of outlet passages (11a, 11b) each outlet passage communicating with a respective outlet port, each of said outlet passages being branched into a supply passage (12a, 12b) for supplying working fluid to a confluent supply line for a fluid driven apparatus (G) and a reflux passage (13a, 13b) for returning the working fluid to a working fluid reservoir (F);

means provided in said reflux passages for selectively switching a plurality of flow passages for the working fluid supplied from each of the outlet ports (9a, 9b) to either the supply passage or the reflux passage so as to provide a plurality of different volumetric discharges by combination of the volumetric discharges from each of the outlet ports;

a plurality of check valves (15a, 15b), provided respectively in each of the supply passages (12a, 12b) to prevent back-flow of the working fluid;

said switching means including an electromagnetic solenoid valve associated with each of the reflux passages in a manner so as to selectively return the working fluid from each of the outlet ports to the reservoir;

said electromagnetic solenoid valve including a plurality of spools slidably accommodated within a plurality of spool chambers so as to allow selective combination of the volumetric discharges from each of the outlet ports (9a, 9b) and said spools being arranged in series to each other with regard to the reflux passages.

2. A variable discharge radial plunger pump comprising:

a plurality of pumping units (I, II), each pumping unit including at least one plunger chamber (5a, 5b) slidably accommodating a plunger (7a, 7b) associated with a rotatable pump shaft (2) having driven connection with an engine, for pressurizing working fluid within said plunger chamber, each of said pumping units including an outlet port (9a, 9b) discharging a particular volumetric discharge of the working fluid pressurized within said plunger chamber;

a plurality of outlet passages, each outlet passage communicating with a respective outlet port, each of said outlet passages being branched into a supply passage (12*a*, 12*b*) for supplying the working fluid to a confluent supply line for a fluid driven apparatus (G) and a reflux passage (13*a*, 13*b*) for returning the working fluid to a working fluid reservoir (F);

means provided in said reflux passages for selectively switching a plurality of flow passages for the working fluid supplied from each of the outlet ports (9*a*, 9*b*) to either the supply passage or the reflux passage so as to provide a plurality of different volumetric discharges by combination of the volumetric discharges from each of the outlet ports;

a plurality of check valves (15*a*, 15*b*), provided respectively in each of the supply passages (12*a*, 12*b*) to prevent back-flow of the working fluid;

said switching means including an electromagnetic solenoid valve connected to each of the reflux passages and the reservoir in a manner so as to selectively return the working fluid from each of the outlet ports to the reservoir;

said electromagnetic solenoid valve including a plurality of spools slidably accommodated within a plurality of spool chambers so as to allow selective combination of the volumetric discharges from each of the outlet ports (9*a*, 9*b*) and said spools being arranged in series to each other with regard to the reflux passages.

* * * * *